US008133024B1

(12) United States Patent
Liang

(10) Patent No.: US 8,133,024 B1
(45) Date of Patent: Mar. 13, 2012

(54) TURBINE BLADE WITH ROOT CORNER COOLING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 528 days.

(21) Appl. No.: 12/489,597

(22) Filed: Jun. 23, 2009

(51) Int. Cl.
*F01D 5/08* (2006.01)

(52) U.S. Cl. ..... 416/1; 415/115; 416/97 R

(58) Field of Classification Search ..... 415/115; 416/1, 95, 97 R, 96 R
See application file for complete search history.

(56) References Cited

U.S. PATENT DOCUMENTS 5,947,687 A 9/1999 Mori et al.
6,402,471 B1 6/2002 Demers et al.
6,416,284 B1 7/2002 Demers et al.
6,431,832 B1 * 8/2002 Glezer et al. ..... 416/97 R
6,431,833 B2 8/2002 Jones
7,097,417 B2 8/2006 Liang
7,131,817 B2 11/2006 Keith et al.
7,249,933 B2 7/2007 Lee et al.
7,497,661 B2 3/2009 Boury et al.
7,621,718 B1 * 11/2009 Liang ..... 415/115
7,775,769 B1 * 8/2010 Liang ..... 416/97 R

* cited by examiner

*Primary Examiner* — Igor Kershteyn
(74) *Attorney, Agent, or Firm* — John Ryznic

(57) ABSTRACT

The turbine rotor blade with an aft flowing serpentine flow cooling circuit that discharges into a trailing edge cooling circuit and then into a row of exit cooling slots to cool the trailing edge, in which a vortex cooling chamber is formed in the blade platform and root section just below the trailing edge of the airfoil, the vortex chamber receiving cooling an bled off from the root turn of the serpentine flow circuit to produce a vortex flow of the cooling air and provide cooling for this section of the blade root. The vortex cooling air is then discharged through a row of exit cooling holes that open onto the side edge of the platform on the pressure side to cool the blade mate-face and to purge an aft rim cavity.

13 Claims, 6 Drawing Sheets

TURBINE BLADE WITH ROOT CORNER COOLING

GOVERNMENT LICENSE RIGHTS

None.

CROSS-REFERENCE TO RELATED APPLICATIONS

None.

BACKGROUND OF THE INVENTION

1. Field of the Invention

The present invention relates generally to a gas turbine engine, and more specifically to an air cooled turbine rotor blade.

2. Description of the Related Art Including Information Disclosed Under 37 CFR 1.97 and 1.98

A gas turbine engine, such as an industrial gas turbine (IGT) engine, includes a turbine with multiple rows or stages or stator vanes that guide a high temperature gas flow through adjacent rotors of rotor blades to produce mechanical power and drive a bypass fan, in the case of an aero engine, or an electric generator, in the case of an IGT. In both cases, the turbine is also used to drive the compressor.

In the turbine section of the gas turbine engine, stages or rotor blades and stator vanes are used to guide the hot gas flow through and react with the rotor blades to drive the engine, to improve engine efficiency, the upstream stages of these airfoils (vanes and blades) are cooled with cooling air to produce convection cooling, impingement cooling, and even film cooling of the outer airfoil surfaces in order to allow for exposure to higher gas flow temperatures. The higher the turbine inlet temperature of the turbine, the higher will be the turbine efficiency and thus the engine efficiency. However, the highest temperature allowed is dependent upon the material properties of these airfoils, especially for the first stage airfoils, and the amount of cooling provided.

Higher levels of cooling can be used for these airfoils. However, since the pressurized cooling air is from the compressor, the more cooling air used from the compressor the more compressed air and work performed by the compressor that is not turned into useful work by the engine, the engine efficiency also decreases due to the extra work performed on compressing the cooling air which is then discharged into the hot gas flow so that not work is performed.

Especially for an industrial gas turbine engine, erosion or corrosion damage to a stator vane or a rotor blade in the turbine section can cause significant decrease in the engine performance or even an airfoil damaged so much that the engine must be prematurely shut down and the damaged airfoil replaced. An industrial gas turbine engine of the kind used in electric power production is intended to operate without stopping for a period of 40,000 hours or more. If an airfoil is damaged enough, the performance of the engine can be decreased such that the operating cost will be much higher. Thus, turbine airfoils are designed to minimize or eliminate the occurrence of hot spots that can result in these types of damage.

FIG. 1 shows a first stage turbine rotor blade of the prior art as disclosed in U.S. Pat. No. 5,947,687 issued to Mori et al. on Sep. 7, 1999 and entitled GAS TURBINE MOVING BLADE. FIG. 2 shows a cross section view of the cooling circuit for the prior art rotor blade of FIG. 1. This particular rotor blade includes two separate serpentine flow cooling circuit to provide cooling for the blade, one serpentine circuit in the forward section and another in the rear or aft section. The forward serpentine circuit is a 3-pass forward flowing serpentine with a first leg 11 for supplying pressurized cooling air, a second leg 12 and a third leg 13 located adjacent to a leading edge impingement channel 15 that includes a showerhead arrangement of film cooling holes 16 and even gill holes 17 on the pressure wall side. A row of film cooling holes 18 on the suction side wall is connected to the third leg 13.

The FIG. 2 blade includes a second serpentine circuit with a first leg 21 adjacent to the first leg 11 of the forward section serpentine circuit, a second leg 22 and a third leg 23 located adjacent to a trailing edge region of the blade airfoil. The first leg 21 is the supply channel for the aft serpentine flow circuit. The trailing edge section includes an arrangement of impingement holes or pedestals 25 that cool the trailing edge region, and then a row of exit holes or slots 26 to discharge the cooling air from the rear section serpentine flow circuit. the last leg 23 is connected through a row of impingement holes 28 to the trailing edge cooling circuit, and a row of film cooling holes 27 on the pressure side wall is connected to the last leg 23.

FIG. 3 shows a cross sectional side view of the blade cooling circuit for FIGS. 1 and 2 of the Mori et al invention. As seen in FIG. 3, the last leg 13 of the forward section serpentine circuit is located adjacent to the leading edge impingement channel 15, while the last leg 23 of the rear section serpentine flow circuit is located adjacent to the trailing edge cooling circuit with the pedestals or impingement holes 25. the cooling air flew in the rear section serpentine circuit flows from the root and into the first leg 21 toward the blade tip, then turns and flows into the second leg 22 toward the root section, and then turns again at the root and platform sections to flow up and into the third or last leg 23 along the trailing edge region. The cooling air from the trailing edge cooling circuit is discharged through the trailing edge exit slots 26 arranged along the trailing edge as seen in FIG. 4. A trailing edge fillet 31 forms a smooth transition between the airfoil surface 32 and the platform on the blade 33. In this prior art blade, a large amount of metal mass 34 is formed between the trailing edge fillet and the platform that is undercooled in this arrangement.

For the blade trailing edge root section in the FIG. 4 prior art blade, due to the hot gas migration from the blade upper span down to the trailing edge and platform region, the blade aft fillet region experiences a hotter gas flow temperature. In addition, at the blade trailing edge fillet location 31, a higher heat transfer coefficient or heat load is formed on the fillet location due to the trailing edge wake effect. On top of a higher heat load onto the airfoil root section fillet 31, due to a stress concentration issue, the cooling slot for the airfoil trailing edge root section cannot be located low enough into the blade root section region to provide proper convection cooling. Cooling for this part of the airfoil trailing edge fillet region becomes especially difficult. A high thermally induced stress is predicted at the junction of the blade trailing edge and the platform location in the prior art blade design. Also, due to the different effectiveness levels of cooling used for the blade and the platform, and because of the mass metal distribution between the blade airfoil and the platform, the thermally induced strain during transient cycle (stopping and starting the engine, or going from steady state operation to less than steady state and back) becomes much more severe.

BRIEF SUMMARY OF THE INVENTION

It is an object of the present invention to provide for a turbine rotor blade of the prior art design with a lower metal temperature in the area of the trailing edge between the airfoil and the platform sections.

It is another object of the present invention to provide for a turbine rotor blade of the prior art with a longer LCF life.

It is another object of the present invention to provide for a turbine rotor blade of the prior art with a lower trailing edge fillet region metal temperature.

These objectives and more can be achieved by including a vortex flow chamber with multiple hole cooling in the platform section of the blade below the airfoil trailing edge root section and connected to the last leg of the rear section serpentine flow circuit to bleed off some of the cooling air and pass this cooling air through the vortex chamber. A row of cooling holes are connected to the vortex chamber to discharge the cooling air out onto the side surface of the platform in on the pressure side edge to provide cooling for the mass metal in the platform section.

The vortex chamber with cooling exit holes functions to soften the blade to the platform which lowers the fillet region metal temperature as well as the stiffness of the trailing edge root section. This results in a better flexibility for the blade trailing edge root section and a lower thermally induced strain.

DETAILED DESCRIPTION OF THE INVENTION

Figure 1:
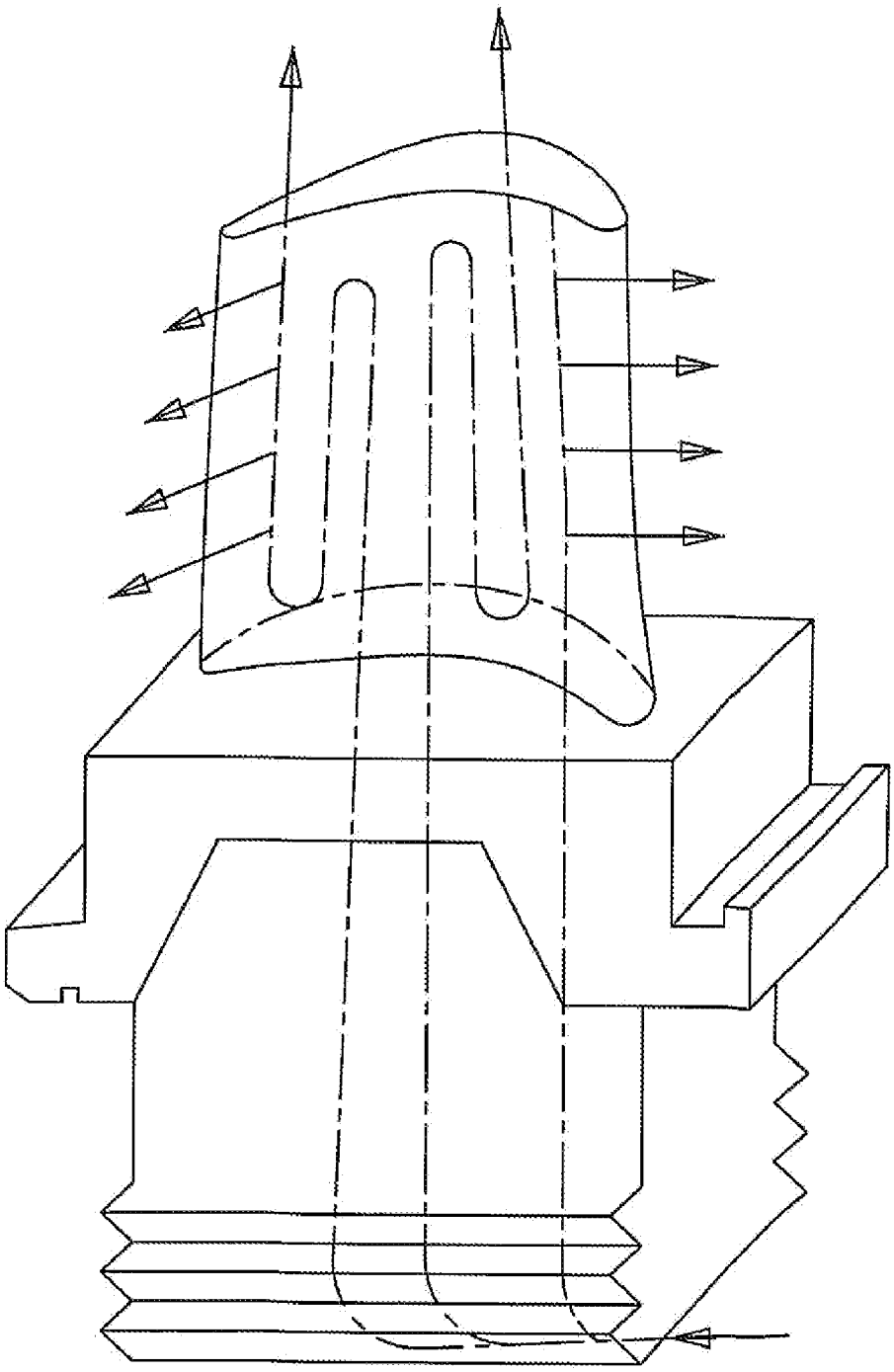
Fig 1 Prior Art
FIG. 1 shows isometric view of a first stage turbine rotor blade of the prior art.
Figure 2:
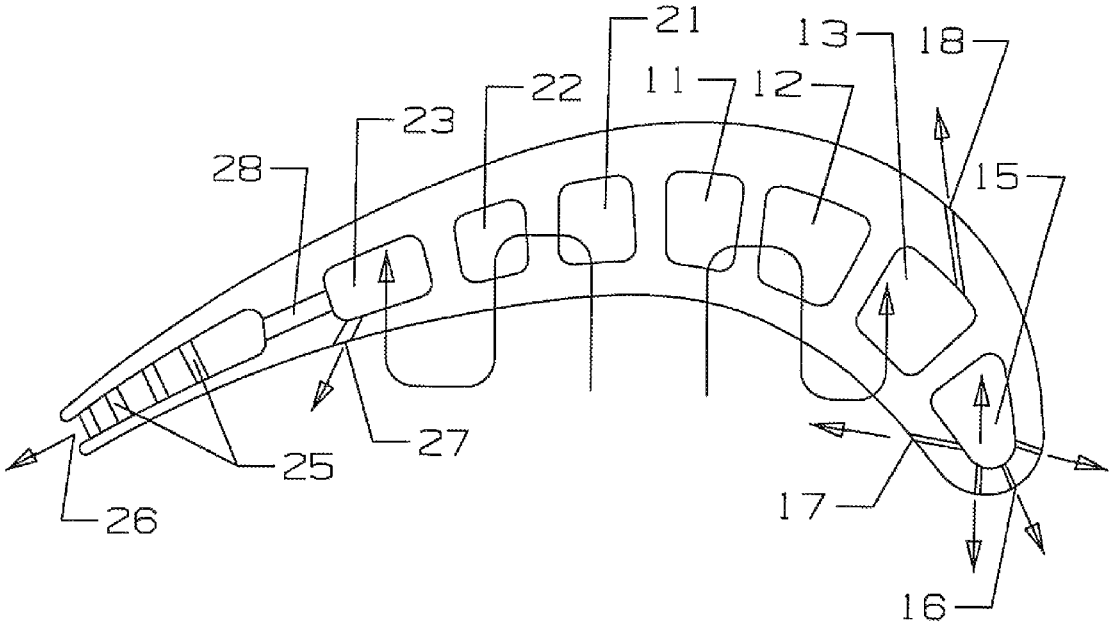
Fig 2 Prior Art
FIG. 2 shows a cross section top view of the internal cooling circuit for the prior art blade of FIG. 1.
Figure 3:
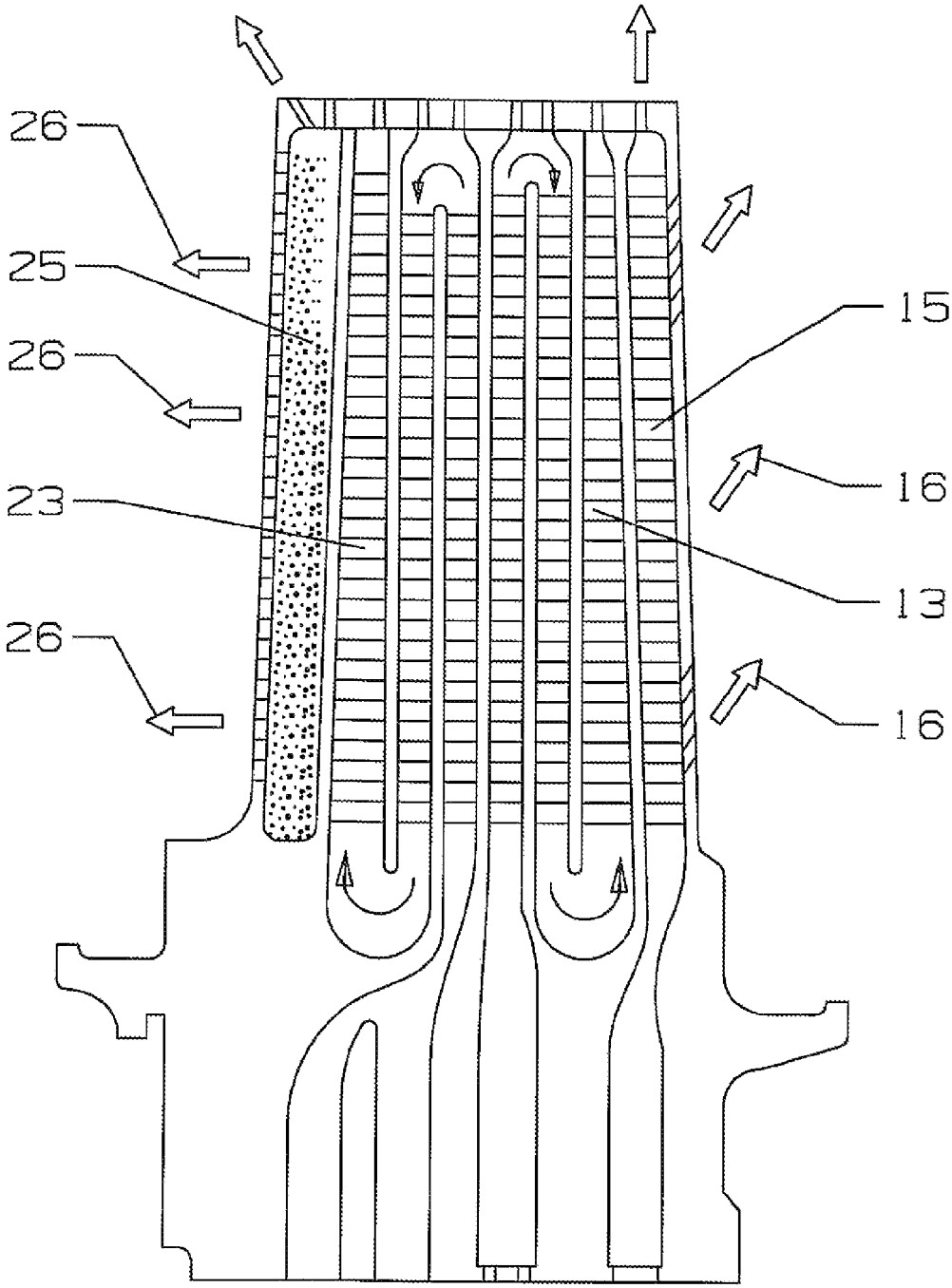
Fig 3 Prior Art
FIG. 3 shows a cross section side view of the internal cooling circuit for the prior art blade of FIGS. 1 and 2.
Figure 4:
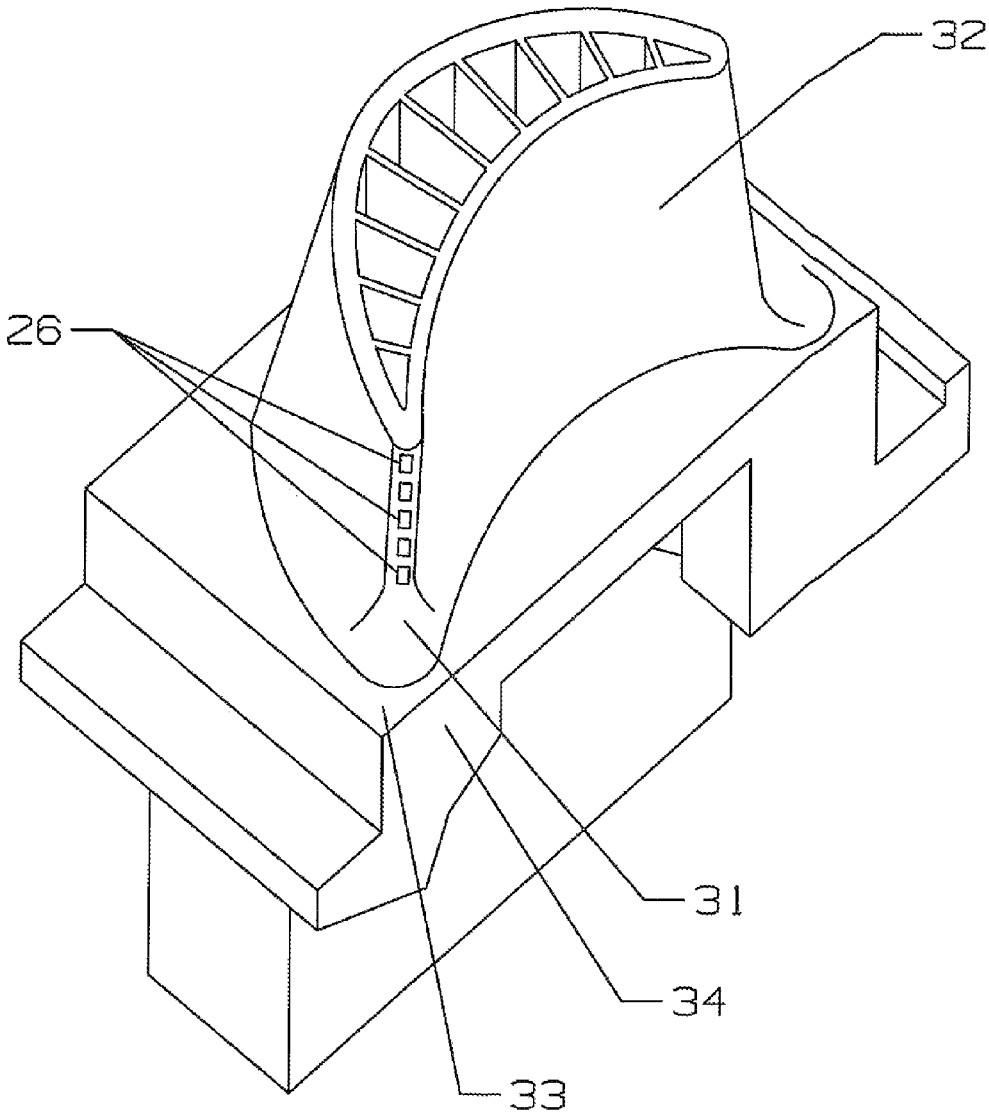
Fig 4 Prior Art
FIG. 4 shows an isometric view of the trailing edge region of the prior art blade of FIGS. 1 through 3.
Figure 5:
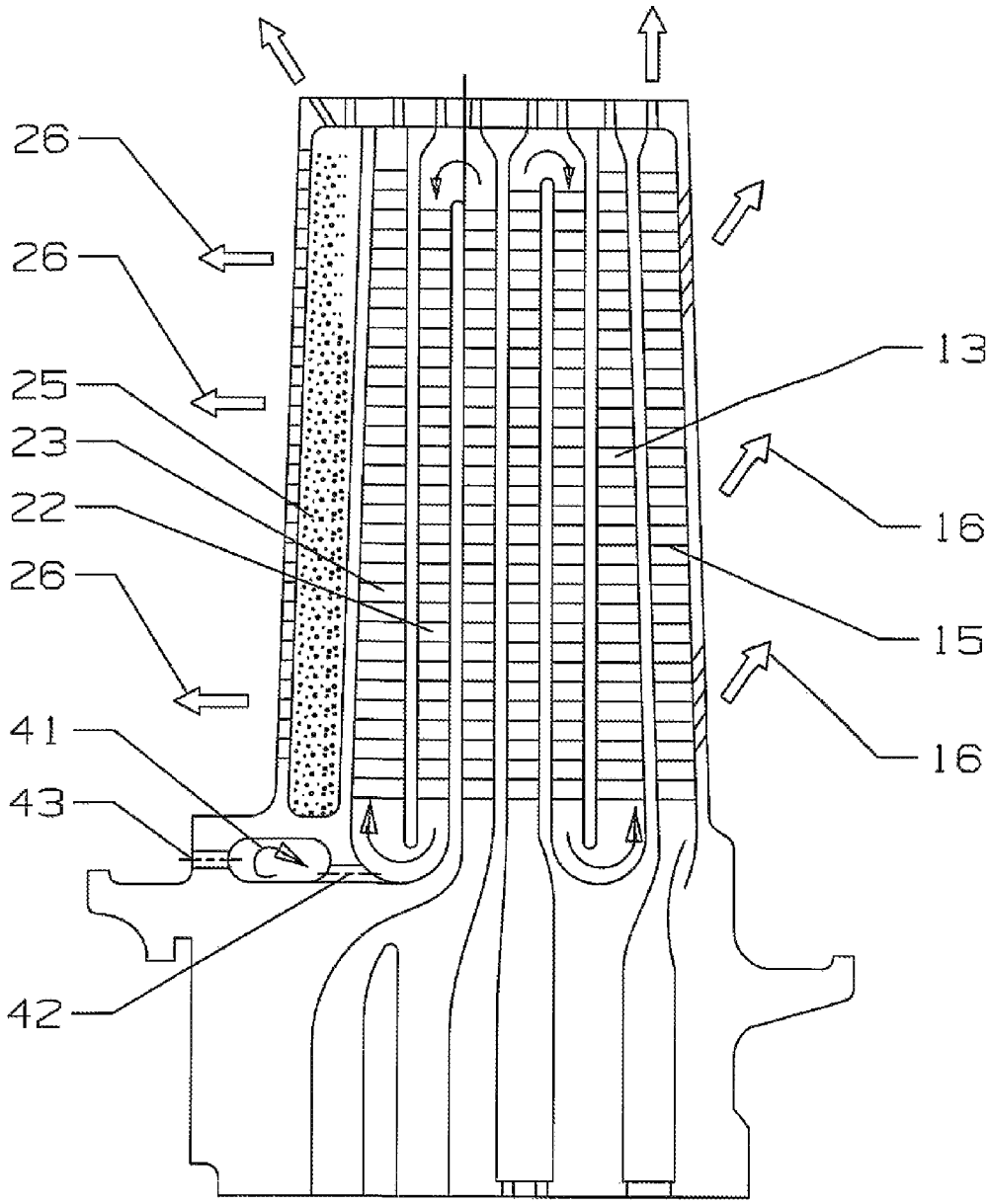
FIG. 5 shows a cross section side view of the cooling circuit for the blade of the present invention.
Figure 6:
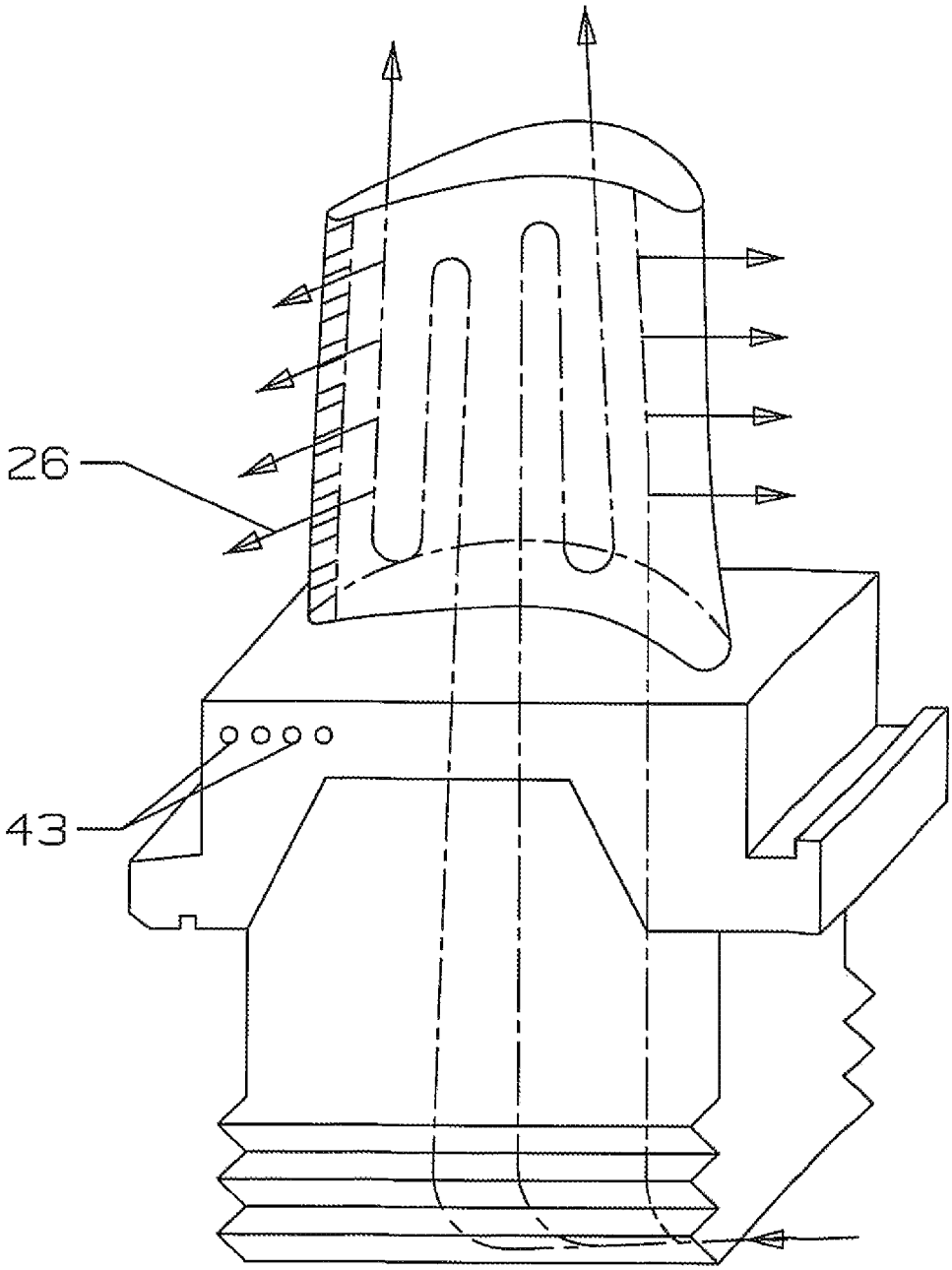
FIG. 6 shows an isometric view of the blade of the present invention from the pressure wall side.

The present invention is an improvement in the cooling circuit of the prior art Mori et al. first stage turbine rotor blade. The blade of the present invention includes all of the internal cooling passages of the Mori blade as disclosed in the Mori et al patent, but adds an additional feature. the improvement includes in the prior art blade a vortex chamber 41 located just below the trailing edge fillet and in the root and platform section as seen in FIG. 5. The vortex chamber 41 is connected to the blade root turn between the second leg 22 and the third leg 23 of the rear section serpentine flow circuit by a cooling supply slot 32. The vortex chamber 41 is connected by a row of cooling holes 43 to a pressure wall side of the platform as seen in FIG. 6. In this embodiment, four cooling air holes 43 are sued. However, more or less than four cooling holes can be used if the number and size of the cooling holes 43 can produce the desired result in cooling of the mass metal in the root and platform section at the trailing edge as described above.

The cooling supply slot 42 that operates as the cooling air inlet for the vortex chamber 41 is offset from the cooling air holes 43 that operate as the outlet or exhaust for the vortex chamber 41. This offset produces the vortex flow pattern in the air flow that increases the heat transfer coefficient and adds additional cooling capability to the blade.

The Mori et al blade root section fillet region thermal and structural issues can be improved by the use of the vortex chamber adjacent to the blade root turn serpentine flow circuit and under the blade trailing edge cooling region of the present invention. The cooling air bleed slot 42 is located at an off-set position relative to the vortex chamber 41 and connected to the bottom surface of the serpentine root turn surface. As the cooling air turns from the second leg 22 and into the third and last leg 23, a portion of the cooling air is bled off from the bottom of the blade root turn region and flows into the vortex chamber 41. Since the cooling air bleed slot 42 is offset, a vortex flow pattern is generated within the vortex chamber 41 for the cooling of the additional blade root section corner. The multiple small cooling holes 43 are drilled through the blade root section fillet metal section and into the vortex chamber 41 to provide proper cooling for the fillet region prior to being discharged onto the blade mate face and aft rim cavity.

Major advantages of the cooling circuit of the present invention for the prior art blade as described below. A lower stress due to careful positioning of the multiple cooling holes 43 is produced.

Higher cooling effectiveness is produced due to an increase backside cooling and increase internal cooling convection area This results in a cooler root section fillet metal temperature and a higher LCF as well as a high cycle fatigue (HCF) capability. LCF is below 100,000 hours, while HCF is above 100,000 hours of operation.

A lower thermal gradient is produced due to a thinner wall coupled with the blade root section to the platform. This results in a lower thermal stress and strain range and a higher blade operating life.

The multiple cooling holes undercut the airfoil fillet location. This particular design approach will soften the trailing edge stiffness and enhance the airfoil LCF capability.

The spent cooling air exiting from the multiple cooling holes can be used for the blade mate-face cooling as well as an aft rim cavity purge air. This doubles the use of the cooling air and improves the turbine stage efficiency.

I claim the following:

1. An air cooled turbine rotor blade comprising:

an aft flowing serpentine flow cooling circuit formed within the airfoil of the blade;

the aft flowing serpentine flow circuit including a last leg adjacent to a trailing edge region of the airfoil;

a trailing edge cooling circuit connected to the last leg of the aft flowing serpentine flow circuit;

a row of cooling air exit slots arranged along the trailing edge and connected to the trailing edge cooling circuit;

a vortex chamber fully contained within a root section of the blade and below the trailing edge of the airfoil;

a cooling air slot connected between the vortex chamber and the aft flowing serpentine flow circuit to supply a portion of the cooling air into the vortex chamber; and a cooling air exit hole connected to the vortex chamber and opening on a side of the platform to discharge the cooling air from the vortex chamber.

2. The air cooled turbine rotor blade of claim 1, and further comprising:

the cooling an slot is connected to a blade root turn formed between the last leg of the aft flowing serpentine flow circuit and a second-to-last leg.

3. The air cooled turbine rotor blade of claim 1, and further comprising:

the cooling air slot is offset from the vortex chamber such that a vortex flow is formed within the vortex chamber.

4. The air cooled turbine rotor blade of claim 1, and further comprising:

the cooling air exit hole is a plurality of holes and opens onto the platform side wall on the pressure side.

5. The air cooled turbine rotor blade of claim 4, and further comprising:

the plurality of cooling air exit holes is parallel to the platform outer surface.

6. A process for cooling a trailing edge root section of a turbine rotor blade, the process comprising:

passing cooling air along a serpentine flow path toward a trailing edge region of the blade airfoil;

cooling a trailing edge region of the airfoil with the spent cooling air from the serpentine flow path;

discharging the cooling air from the trailing edge region through cooling air exit slots to cool the trailing edge of the airfoil;

bleeding off a portion of the serpentine flow cooling air and forming a vortex flow pattern to cool the trailing edge root section; and, discharging the vortex flowing cooling air onto a side surface of the platform.

7. The process for cooling a trailing edge root section of claim 6, and further comprising the step of:

bleeding off the portion of the serpentine flow cooling air at a root section turn in the serpentine flow cooling path.

8. The process for cooling a trailing edge root section of claim 6, and further comprising the step of cooling the blade mate-face with the cooling air discharged from the vortex flow chamber.

9. The process for cooling a trailing edge root section of claim 8, and further comprising the step of:

purging an aft rim cavity with the cooling air discharged from the vortex flow chamber.

10. A turbine rotor blade comprising:

a multiple pass serpentine flow cooling circuit located adjacent to a trailing edge region of the blade;

a root turn channel located in the blade root and connected to the multiple pass serpentine flow cooling circuit;

a vortex flow generating chamber located in the blade platform and root section and below the trailing edge of the airfoil;

a cooling air supply duct connecting the vortex flow generating chamber to a root turn of the last two legs of the aft flowing serpentine flow circuit; and, a row of exit cooling holes connecting the vortex flow generating chamber to a side of the platform.

11. The turbine rotor blade claim 10, and further comprising:

the cooling air supply duct is offset from the vortex flow generating chamber.

12. The turbine rotor blade of claim 10, and further comprising:

the row of exit cooling holes open onto the pressure side of the platform side edge.

13. The turbine rotor blade of claim 12, and further comprising:

the row of exit cooling holes are parallel to the outer platform surface.

* * * * *